US005185489A

United States Patent [19]

Hoshino

[11] Patent Number: 5,185,489

[45] Date of Patent: Feb. 9, 1993

[54] DRUM HOOP CLAMP STRUCTURE ON DRUM PEDAL

[75] Inventor: Yoshihiro Hoshino, Nagoya, Japan

[73] Assignee: Hoshino Gakki Co., Ltd., Japan

[21] Appl. No.: 730,693

[22] Filed: Jul. 16, 1991

[30] Foreign Application Priority Data

Jan. 31, 1991 [JP] Japan ..... 3-009631[U]

[51] Int. Cl.[5] ..... G10D 13/02

[52] U.S. Cl. ..... 84/422.1

[58] Field of Search ..... 84/422.1, 422.2

[56] References Cited

U.S. PATENT DOCUMENTS 2,132,211 11/1936 Hueckstead ..... 84/422.1
3,316,792 6/1965 Ippolito ..... 84/422.1
4 538,499 9/1985 Livingston ..... 84/422.1
4,747,333 5/1988 Hoshino ..... 84/422.1

*Primary Examiner*—Michael L. Gellner
*Assistant Examiner*—Cassandra C. Spyrou
*Attorney, Agent, or Firm*—Ostrolenk, Faber, Gerb & Soffen

[57] ABSTRACT

A drum hoop clamp includes a pivotable clamp body supported on the drum beater as a pivot base for the clamp body and a clamping jaw rotatably journaled to the clamp body at one side of the clamp body pivot. When the clamp body pivots to move the clamp jaw against the drum hoop, the rotatable clamp jaw rotates with respect to the clamp body to an orientation providing fullest contact between the clamping surface of the clamp jaw and the drum hoop, regardless of the shape of the clampable surface of or the thickness of the drum hoop.

9 Claims, 5 Drawing Sheets

DRUM HOOP CLAMP STRUCTURE ON DRUM PEDAL

BACKGROUND OF THE INVENTION

The invention relates to a drum hoop clamping structure that is associated with the drum pedal of a drum for stably positioning the drum with reference to the drum pedal As is shown in prior art FIG. 5 hereof, a prior art hoop clamping structure for a bass drum includes a hoop clamp 71 on a drum pedal device 70 and the clamp engages the drum head hoop 62 which is provided on the drum body 61 of the bass drum 60. The hoop clamp is tightened and then fixed by a T bolt 72, which secures the drum pedal 70 to the bass drum 60. The pedal operated drum beater is supported on a base 74, and the beater is operated by a pedal plate.

In this known hoop clamping structure, however, as shown in prior art FIG. 6, clamping is performed with the tip of the drum head hoop engaging part 79 being raised. It becomes impossible to hold the hoop 63 on the entire engaging surface of the part 79, thereby making the connection between the bass drum and the drum pedal unstable when the T bolt 72 is tightened as shown in FIG. 6, especially in the case of a quite thick drum hoop.

In the case of a thinner drum hoop, as shown in prior art FIG. 7, on the other hand, the tightening of the T bolt 72 leaves the rear edge of the engaging part 79 elevated, thereby making it difficult to reliably hold the drum hoop 64 and causing the drum pedal device 70 itself to become unstable, among other problems.

SUMMARY OF THE INVENTION

The invention attempts to solve the above problems A hoop clamping structure on the drum pedal can firmly clamp on the hoop without the drum pedal being shaky, even with drums having different hoop thicknesses.

In the invention, a holding jaw of the clamp body has a bottom surface that engages the top side of the drum hoop below it. The holding jaw is mounted to be freely rotatable at the movable clamping tip of the main clamp body at the drum pedal. Upon pivoting of the clamp body with reference to its support base, which causes engagement of the bottom clamping surface of the holding jaw of the clamp body upon the clampable top surface of the drum hoop, the holding jaw rotates with respect to the clamp body so that the clamping surface of the holding jaw sits as flat as possible on the clampable top surface of the drum hoop, regardless of the thickness of or the incline of the clampable surface of the drum hoop. Preferably, the drum hoop is sandwiched and held between the clamping jaw and a portion of the base for the pivotable clamp body. This clamping prevents the drum body from becoming shaky due to the vibrations from beating the drum and prevents the drum pedal from becoming unstable.

To clamp the drum hoop at the drum pedal, a holding jaw on the clamp body engages the drum hoop, and that jaw is freely rotatable at the tip of the main hoop clamp body of the drum pedal.

Other objects and features of the invention are explained with reference to the accompanying drawings.

DESCRIPTION OF THE PREFERRED EMBODIMENTS

Figure 1:
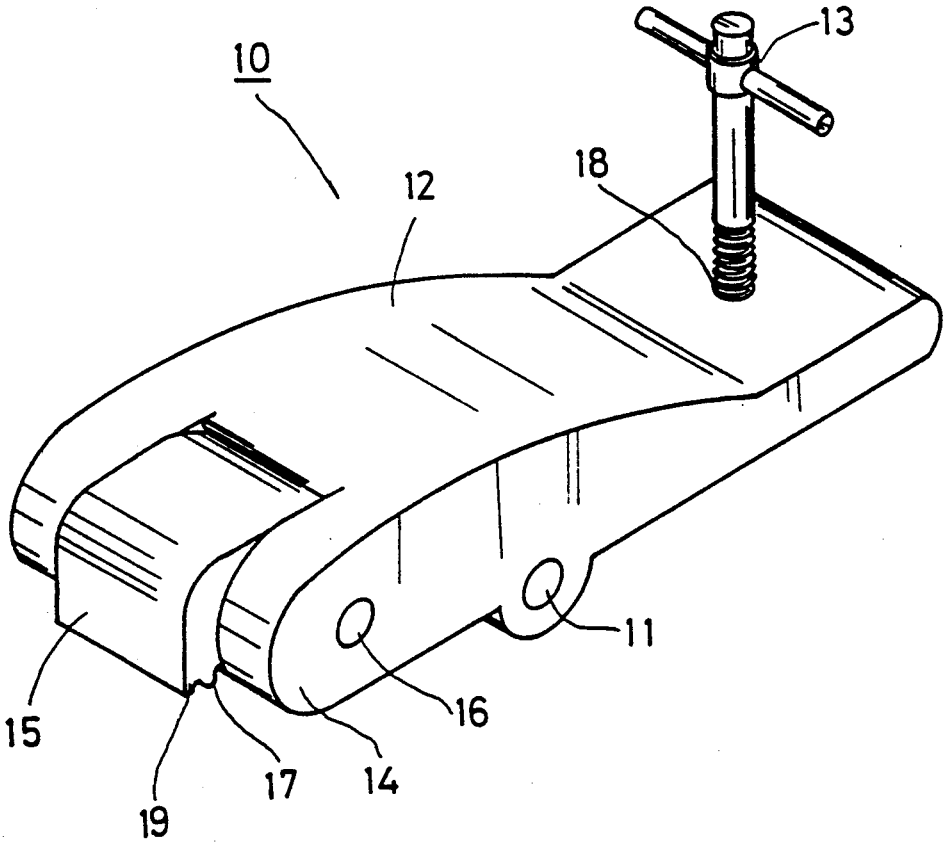
FIG. 1 is a perspective view of a drum hoop clamping structure associated with a drum pedal according to the invention.

Referring to FIG. 1, the hoop clamp 10 of the invention is comprised of either metal, hard plastic or a combination of elements of both types of material. The main clamp body 12 is journaled at axis hole 11 on the base 30 of the drum pedal device, which is described below. The main body 12 of the clamp projects from its pivot mount at axis 11 toward the drum head at the drum hoop 32.

At that part of the main body 12 of the hoop clamp 10 that is over the drum hoop 32, and that is also toward one side of the below discussed axis hole 11 for the pivot mount of the main body, there is a holding jaw 15 that engages and secures the drum hoop. The jaw 15 is journaled to be freely rotatable at the axis 16 on the main body as its rotation center. The jaw 15 is rotatable so that its bottom clamping surface 17 engages the top of the hoop 32 flat or stably with any normal thickness of the drum hoop and the jaw engages the hoop.

In this example, there is a concavo-convex or toothed nonskid bottom surface 17 defining the drum hoop engaging surface of the holding jaw 15.

In the rear part of the main body 12 of the clamp, to the other side of the axis hole 11, there is a screw hole 18 for receiving a screwed in T bolt 13 which is used for pivoting the main body with the jaw 15 to clamp to or later unclamp from the drum hoop.

Figure 2:
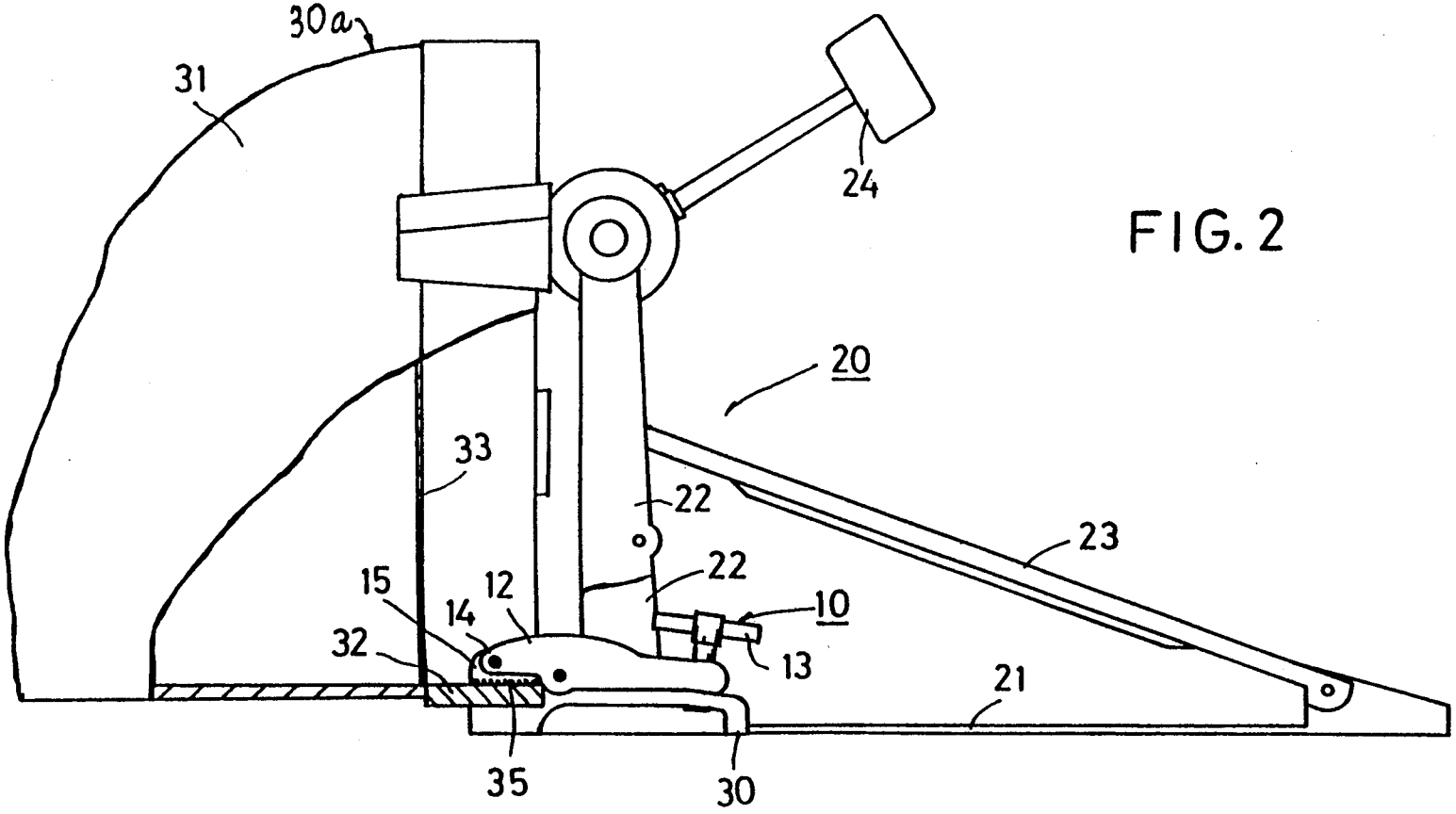
FIG. 2 is a partially cut away side view of a drum pedal device utilizing the hoop clamp for the drum pedal according to the invention.

FIG. 2 shows a drum pedal device 20 which uses the hoop clamp. The device 20 comprises a seat plate 21 at the bottom which extends rearward from a base 30, supports 22 which are provided on both lateral sides of the seat plate 21 and the base 30, a known pedal plate 23 which is pivotally attached to the seat plate 21 at the rear end of both of them and the pedal plate 23 is attached in known manner, e.g. by a sprocket and chain connection, to a beater 24. The hoop clamp 10 is provided at the middle part of the support 22 and is seated on the base 30.

A conventional drum hoop 32 is provided toward the end of the drum body 31 of the bass drum **30*a*. The hoop 32 holds the peripheral edge of a drum head 33 to the drum body in the conventional manner. The top surface of the drum hoop 32 is clamped by the jaw 15 on the main body 12 of the hoop clamp 10 upon appropriate rotation of the T bolt 13, and this installs and fixes the drum pedal device 20 on the bass drum 30A**.

Because the holding jaw 15 is freely rotatably supported to the main body 12, the holding jaw 15 rotates to reorient itself according to the height and thickness of the drum hoop. This enables the entire undersurface of the jaw or at least the major area thereof to engage the top surface of the drum hoop. The drum hoop is clamped firmly by the entirety of the engaging undersurface 19 of the jaw. The base 30 of the pedal device and of the clamp has a forwardly projecting part 35 beneath the hoop 32 and the hoop is inserted into the open space initially present between and is sandwiched between that projecting part 35 and the jaw 15, 17.

Figure 3:
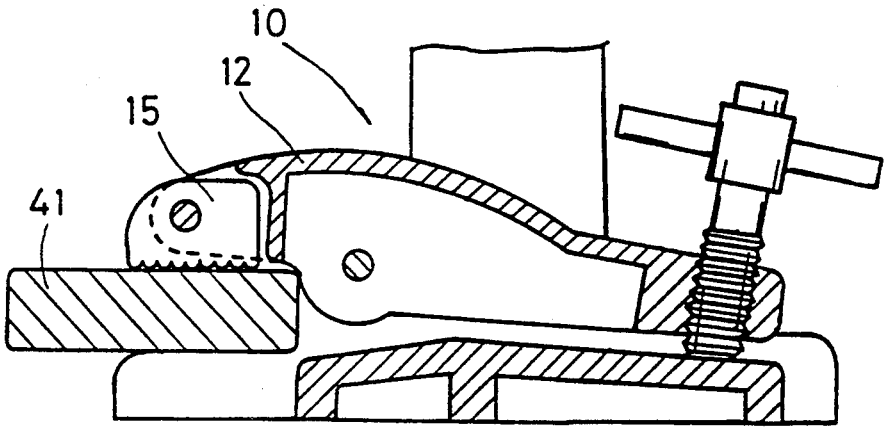
FIG. 3 is a side, cross sectional view of the essential part of the hoop clamp at the drum hoop.

As can be seen in FIG. 3, the holding jaw 15 rotates with respect to the clamp body 12 so that the bottom surface of the jaw rests flat on the thicker or taller drum hoop 41 even though the hoop clamp 10 is clamped on the thick drum hoop 41. Accordingly, the main clamp body 12 sandwiches and fixes the hoop against the base 30, 35 of the clamp 10 and the pedal device.

Figure 4:
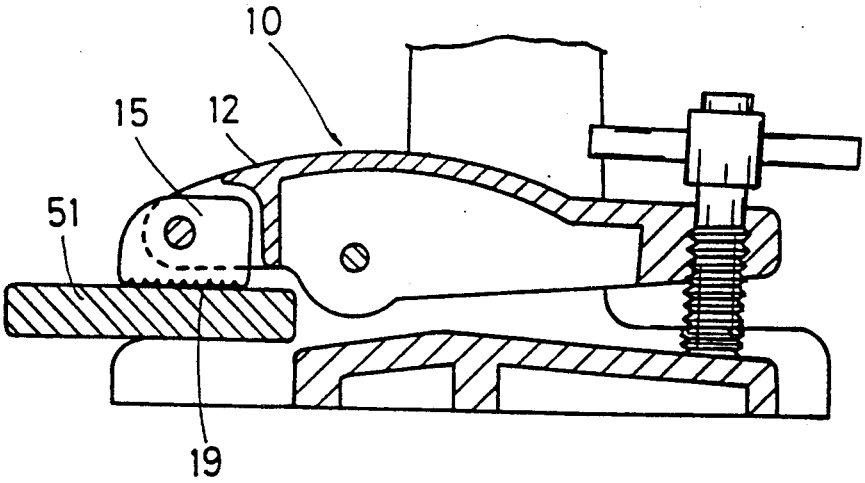
FIG. 4 is a side cross sectional view of another use of the clamp at another drum hoop.
Figure 5:
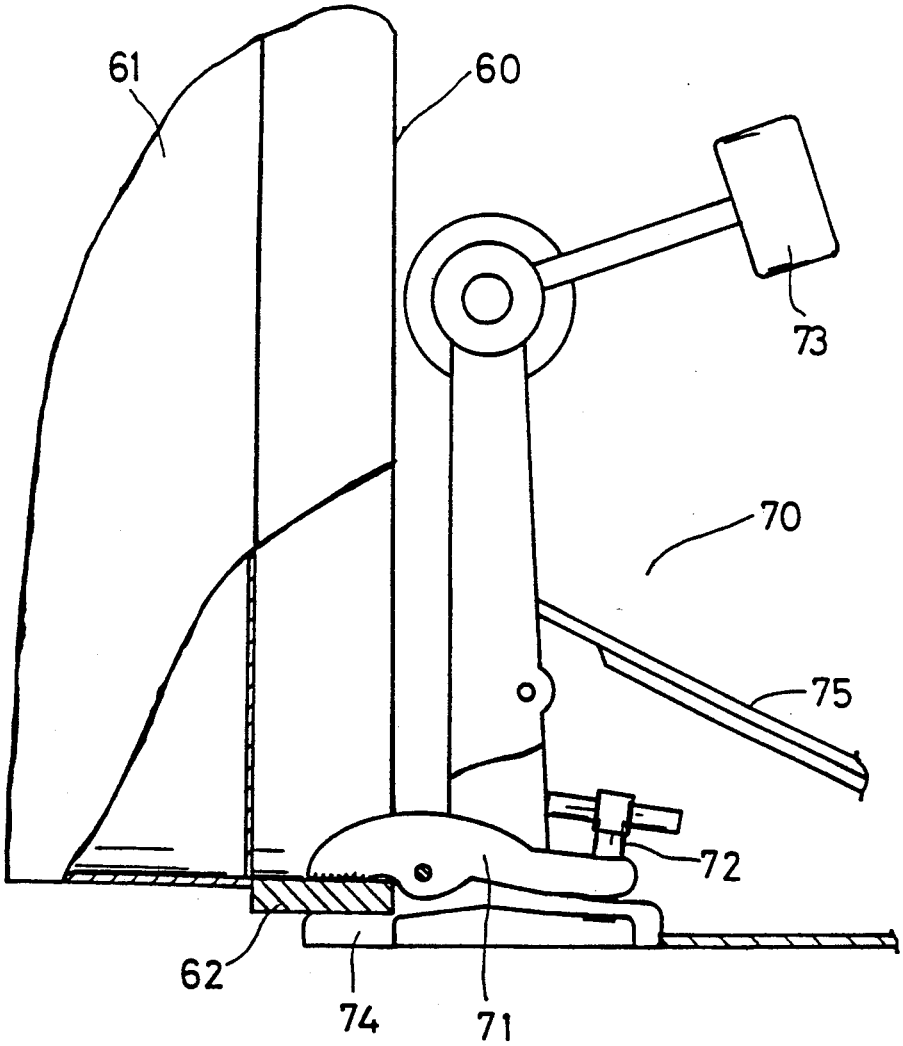
FIG. 5 PRIOR ART
FIGS. 5, 6 and 7 are illustrative of the prior art drum clamp.
Figure 6:
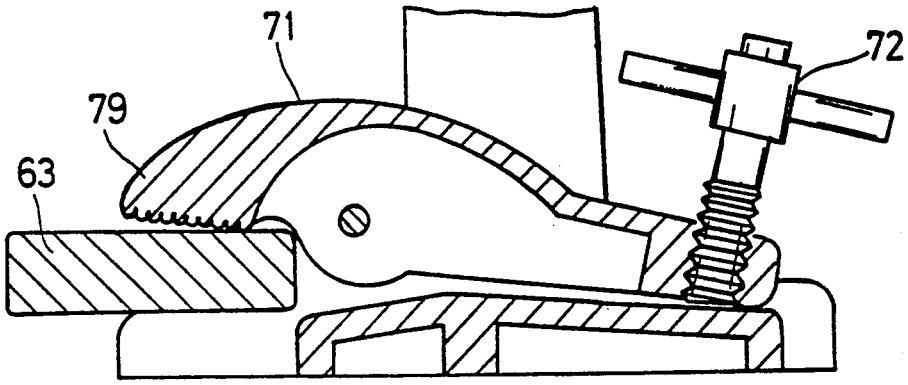
Figure 7:
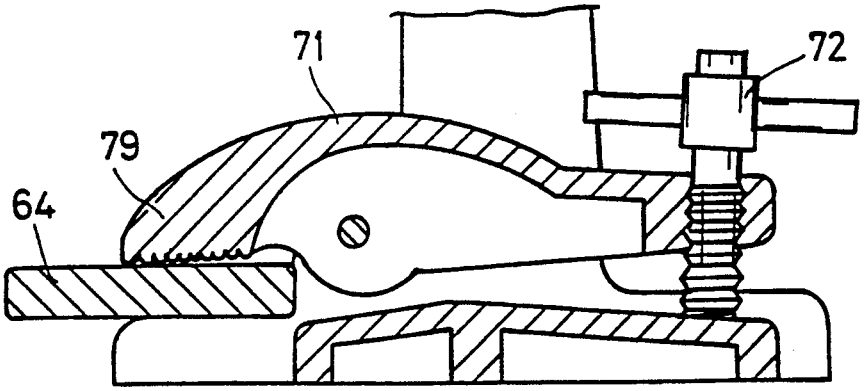

FIG. 4 shows an example where the hoop clamp 10 is clamped to a drum hoop 51 with a much smaller thickness than the hoop 41. In this example, too, the holding jaw 15 of main clamp body 12 rotates with respect to the body 12, thereby holding the drum hoop 51 with the entire clamping surface 19. The rotation orientation of the main body in each example above does not prevent effective full undersurface clamping.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A drum hoop clamp structure comprising a base; a clamp body supported to and movable with respect to the base;

a drum hoop clamp jaw pivotably supported to the clamp body, the jaw including a clamping surface for engaging an opposed clampable surface of the drum hoop, the pivotable support of the jaw enabling the jaw to pivot with respect to the clamp body for the clamping surface of the jaw to adjust its seating to a cooperating opposed clampable surface of a drum hoop regardless of shape and orientation of the clampable surface of the hoop and thickness of the hoop; and means for moving the clamp body with respect to the base for bringing the clamping surface of the jaw into engagement with the clampable surface of the hoop.

2. The clamp of claim 1, wherein the base includes a base portion that is disposed beneath and is normally spaced from the clamping surface of the jaw for defining a space between the base portion and the clamping surface, and the jaw being movable toward and away from the base portion, the space between the clamping surface and the base portion providing an opening for insertion therein of a portion of the drum hoop, and movement of the clamping surface to clamp the drum hoop sandwiching the portion of the drum hoop between the clamping surface and the base portion.

3. The clamp of claim 2, wherein the clamp body moving means is connected between the base and the clamp body and is operable for pivoting the clamp body to move the jaw toward and away from the base.

4. The clamp of claim 1, wherein the clamp body moving means is connected between the base and the clamp body and is operable for moving the clamp body to move the jaw toward and away from the base.

5. The clamp of claim 4, further comprising a clamp body pivot at which the clamp body is pivotally supported to the base for pivoting movement of the clamp body with respect to the base; wherein the clamp body has a first side at which the clamping surface of the jaw is located and which is to one side of the clamp body pivot, the clamp body has a second side at an opposite side of the clamp body pivot from the clamping surface;

the means for moving the clamp body comprises a screw threaded opening in the second side of the clamp body, and a clamping screw passing through the threaded opening in the clamp body and extending in engagement with the base, such that rotating the clamping screw in one direction moves the clamp body with respect to the clamping screw in engagement with the base for urging the jaw toward the drum hoop at the base.

6. The clamp of claim 1, further comprising a movable drum pedal, a drum beater connected with the pedal for being moved by operation of the pedal for beating a drum head associated with the drum hoop; the drum pedal being supported to the base.

7. In combination the clamp of claim 6, and a drum, the drum comprising a drum body having an end, the drum head over the drum body end and the drum hoop around the end of the drum body and holding the drum head to the drum body, the drum hoop projecting above the drum head a distance sufficient to enable the drum hoop to be emplaced beneath the clamping surface of the jaw; and the drum beater being supported to the base for being operated to beat the drum head when the drum hoop is in position to be clamped by the clamping surface of the jaw.

8. A drum hoop clamp structure comprising:

a base; a clamp body, a clamp body pivot at which the clamp body is pivotally supported to the base for pivoting movement of the clamp body with respect to the base;

a drum hoop clamp jaw, a pivot journal at which the jaw is pivotally supported to the clamp body, the jaw including a clamping surface for engaging an opposed clampable surface of a drum hoop, the jaw being pivotally supported at the pivot journal for enabling the jaw to pivot with respect to the clamp body for the clamping surface of the jaw to adjust its seating to a cooperating opposed clampable surface of a drum hoop, regardless of the shape and orientation of the clampable surface of the hoop and the thickness of the hoop;

the clamp body has a first side which is to one side of the clamp body pivot along the clamp body; the pivot journal of the jaw is on the clamp body to the first side of the clamp body pivot, such that the clamp body may be pivoted with respect to the base to move the jaw clamping surface toward and away from the drum hoop; and means for moving the clamp body with respect to the base for bringing the clamping surface of the jaw into engagement with the clampable surface of the hoop.

9. The clamp of claim 8, wherein the jaw is also to the first side of the clamp body pivot as the pivot journal of the jaw.

* * * * *